United States Patent [19]

Setterberg, Jr.

[11] Patent Number: 4,951,746

[45] Date of Patent: Aug. 28, 1990

[54] LATCHING SEAL UNIT

[75] Inventor: John R. Setterberg, Jr., Dallas, Tex.

[73] Assignee: Otis Engineering Corporation, Dallas, Tex.

[21] Appl. No.: 337,360

[22] Filed: Apr. 13, 1989

[51] Int. Cl.[5] ..... E21B 23/00; E21B 33/12

[52] U.S. Cl. ..... 166/114; 166/116; 166/179; 285/26

[58] Field of Search ..... 166/89, 114, 116, 179, 166/217; 285/24, 25, 26, 27, 28, 29; 294/86.32, 86.28

[56] References Cited

U.S. PATENT DOCUMENTS

| | | | |
|---|---|---|---|
| 3,391,741 | 7/1968 | Elliston | 166/123 |
| 3,559,732 | 2/1971 | Tucker | 166/114 |
| 4,289,202 | 9/1981 | Henderson | 166/214 |
| 4,441,553 | 4/1984 | Setterberg, Jr. et al. | 166/217 |
| 4,570,707 | 2/1986 | Setterberg, Jr. | 285/26 |
| 4,620,590 | 11/1986 | Koisuka et al. | 285/24 |

*Primary Examiner*—Bruce M. Kisliuk
*Assistant Examiner*—Terry Lee Melius
*Attorney, Agent, or Firm*—Johnson & Gibbs

[57] ABSTRACT

A latching seal unit for use on a tubing string in a well bore for connecting the tubing string into a well packer having a receiving head provided with one or more latching lugs, the seal unit including a top sub connectable on a tubing string, a tubular locator body connected with the top sub, a latching collet cage having straight-slots mounted on the locator body formed of circumferentially spaced collet fingers defining longitudinal slots and guide surfaces providing entrances into the slots and a latching recess along each of the longitudinal slots, the longitudinal slots being sized to form an interference fit with the latching lugs in the well packer, and the latching recesses being sized to receive the latching lugs, a tubular seal body connected with the locator body, annular seal elements assemblies on the seal body for sealing with a packer bore, and a muleshoe guide on the seal body below the seal element assemblies. The collet cage may be free to rotate or locked against rotation on the seal unit body. The coaction between the collet cage and packer lugs provides a surface detectable indication of proper landing of the unit in a packer. The seal unit is useable with prior art packers and has the advantages of both collet and straight-slot type prior art seal units.

23 Claims, 1 Drawing Sheet

LATCHING SEAL UNIT

This invention relates to seal units, and more particularly relates latching type seal units employed in oil and gas wells to couple a well production tubing string into a well packer.

BACKGROUND OF THE INVENTION

Oil and gas wells, typically, are completed for production by installing a well packer in a well bore to seal with the wall of the well bore or a well casing installed in the well bore. A well production tubing string is then coupled at a lower end into the well packer to conduct oil and/or gas to the surface. The packer seals the annulus in the well bore around the tubing string so that well fluids entering the well bore below the packer are directed into the tubing string to the surface and excluded from the annulus above the packer within the well bore around the tubing string. The packers may be installed using wireline-set, tubing-set, or hydraulic-set equipment and techniques. The production tubing strings may be run with the packer or after the setting of the packer, depending upon the equipment and techniques employed. The production tubing strings are ordinarily releasably coupled along a lower end into the bore of the well packer. A seal unit secured on the lower end of the production tubing sealingly engages the bore of the packer. Where the packer has a receiving head including one or more internal latch lugs, the seal unit may be equipped with a locator body having a J-slot configuration or a straight-slot arrangement. When using a J-slot, the seal unit is securely anchored into the packer so that tension can be applied to the tubing string and rotational torque can be applied to activate a device rotationally while the lower end of the tubing string is anchored. As the J-slot positively locks with the packer lug, it can be determined at the surface when the seal unit is landed and locked with the packer. The positive latch with the packer provided by the J-slot connection has disadvantages, however. Well conditions may develop where heat causes expansion of the production string. An acidizing operation where the tubing is washed down with acid may cause the tubing to contract. Under either circumstance, having a tubing positively latched into the packer may result in destruction of a portion of the coupling between a tubing and a packer. The straight-slot coupling between a seal unit and a packer head provides for torque transfer from the tubing string and allows the tubing string to contract and extend longitudinally, but provides no positive indication of when the seal unit has landed when it is raised after landing in the packer head.

One prior art packer having a receiving head with a latch lug is a type WB Otis Engineering Corporation Packer illustrated at page 14, of the Otis Engineering Catalog No. OEC5120D, published in 1982. Also, shown in such catalog at page 27, are Otis Sealing Assemblies having J-slot and straight-slot locator bodies. Another form of seal assembly shown at page 51 of such Otis Engineering Corporation catalog is a collet-type latch which utilizes radially movable collet fingers having collet bosses which latch in a recess in the packer providing an indication when the seal assembly is latched into the packer, but not permitting either longitudinal movement of the tubing string responsive to expansion and contraction of the tubing or rotation of the tubing string when desired or torque transfer to a packer.

Examples of the use of collet assemblies for connection of a production tubing string into a packer head and body are shown in U.S. Pat. No. 4,570,707 issued Feb. 18, 1986, to John R. Setterberg, Jr. and in U.S. Pat. No. 4,289,202 issued Sept. 15, 1981, to William D. Henderson. A well packer having a head or top sub equipped for operation with a seal unit of the present invention is illustrated and described in U.S. Pat. No. 4,441,553 issued Apr. 10, 1984, to John R Setterberg, Jr., and Dhirajlal C. Patel.

SUMMARY OF THE INVENTION

It is a principal object of the invention to provide a seal unit adapted to latch into the head of a well packer to provide an indication of the landing of the seal unit at the proper location in the well packer.

It is another object of the invention to provide a seal unit which permits expansion and contraction of a production tubing string after landing in a well packer.

Is is another object of the invention to provide a seal unit for well packers which provides an indication of the landing of the seal unit in the well packer, one form of the seal unit permitting the tubing string to be rotated relative to the packer and another form permitting transfer of torque from the tubing string to the packer.

It is another object of the invention to provide a well production tubing string seal unit which is operable with a prior art packer head having latch lug means designed for use with prior art seal assemblies having J-slot and straight-slot locator bodies.

In accordance with the invention, there is provided a well tubing string latching seal unit for use with a well packer having a receiving head lug including a tubular body having an external annular seal assembly for sealing with a bore of a well packer and a latching collet cage mounted on the body for releasably coupling with the latch lug in the receiving head of the well packer. One form of the seal unit includes a collet cage secured against rotation on the body of the seal unit. Another form of the seal unit includes a collet cage which is free to rotate on the body of the seal unit.

Additional objects and advantages of the present invention will be readily apparent to those skilled in the art from the following detailed written description of preferred embodiments of the seal units in conjunction with the accompanying drawings.

A BRIEF DESCRIPTION OF THE DRAWINGS

FIG. 1 is a longitudinal view in section and elevation of a preferred embodiment of a latching seal unit in accordance with the invention;

FIG. 2 is a view similar to FIG. 1 of the latching seal unit of the invention installed in a well packer adapted to be set in the casing of a well, showing the seal unit latched in operating position in the well packer and the well packer parts positioned for running the packer into a well preliminary to setting the packer in the well; and FIG. 3 is a fragmentary upper end portion view in section and elevation of the seal unit of FIG. 1, illustrating a latching collet cage rotatable on the locator body of the seal unit.

DESCRIPTION OF THE PREFERRED EMBODIMENTS

Figure 1:
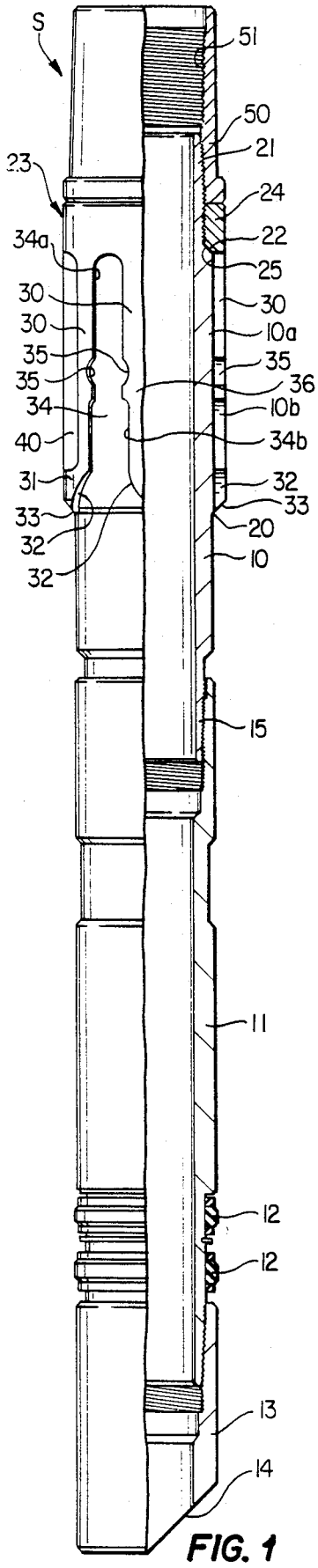

Referring FIG. 1, a latching seal unit S constructed in accordance with the invention has a tubular body defined by a locator body 10 and a seal body 11. The locator body is threaded along a lower end portion into the upper end portion of the seal body. Longitudinally spaced ring seal elements 12 are mounted on the body 11 for sealing around the body 11 with the bore wall of a packer P illustrated in FIG. 2. The seal elements 12 may be formed of a high-modulus rubber compound bonded to and between metal back-up shoes that cause the seal to be pressure energized. An increase in diferential pressure across the seals forces the elements to effect a tighter seal with the bore wall of the packer. A tubular mule-shoe guide 13 is threaded on the lower end portion of the seal body 11. The mule-shoe guide has a downwardly and inwardly tapered end edge guide surface 14 extending from the outer periphery of the body to the center line of the body. The mule-shoe guide is a conventional well tool element used to aid in guiding the seal unit S into the packer body bore. The locator body 10 has an externally threaded reduced lower end portion 15 for engagement of the body 10 in the upper end portion of the body 11. The locator body 10 is enlarged externally along an upper central portion **10*a* providing a tubular external surface 10*b* of uniform diameter. The lower end edge of the enlarged body portion 10*a* defines an external annular downwardly and inwardly tapered stop shoulder 20 which limits the downward movement and supports the seal unit S at a corresponding stop shoulder described hereinafter in the well packer P shown in FIG. 2. The body 10 is reduced and externally threaded along an upper end portion 21. An external annular downwardly and outwardly sloping stop shoulder 22 is formed on the body 10 at the lower end of the threaded portion 21 and the upper end of the body surface 10*b*. In accordance with the invention, a latching collet cage 23 is mounted on the locator body 10 threaded to the reduced upper end portion 21 against the stop shoulder 22. The collet cage has an internally threaded mounting ring portion 24 defining the upper end of the collet cage. An internal stop shoulder 25 on the lower end of the cage ring 24 is engageable with the stop shoulder 22 on the locator body 10 for securely seating the collet cage on the body. The collet cage includes circumferentially spaced integral collet fingers 30 which depend from the ring 24. Alternate pairs of the collet fingers 30 are formed together along lower end portions by cage guide portions 31 which are downwardly extending pointed parts of the collet cage defined by and between edge guide surfaces 32 which merge together at points 33. The adjacent collet fingers 30 which are not joined together are spaced apart defining downwardly opening straight-slots 34. The collet finger edges defining the slots 34 connect with and merge into the guide surfaces 32 which define a downwardly opening entrance or mouth leading into each slot 34. The spaced collet fingers 30 which define the straight-slots 34 have facing edge latch recesses 35 which are aligned with each other for receiving a packer lug as described hereinafter in the well packer P of FIG. 2. Above the recesses 35 the slots 34 are narrower than along the recesses 35 defining an upper slot portion 34*a* which forms an interference fit with the packer lugs. Below the recesses 35 the slots 34 are wider along a portion 34*b* than the packer lugs so that the collet cage easily slides downwardly over the lugs as the guide surfaces 32 direct the cage along the lugs with the lugs entering the wide slot portions 34*b*. Between the recess 35 and the slot portions 34*b*, the collet fingers are provided with lateral latch bosses 36 projecting into the slots 34. The latch bosses are spaced to provide an interference fit with the packer lugs and function to latch the collet cage with the lugs when the bosses 36 move below the lugs and the lugs are in the recesses 35. When the seal unit is then pulled upwardly, the latch bosses 36 resist upward movement of the latch unit which is detected at the surface indicating that the latch unit is properly landed and locked in the packer. The collet fingers 30 which are connected together by the guide portions 31 are also spaced apart defining recesses 40 between the collet fingers. The recesses 40 are closed at opposite ends. The recesses 40 permit the collet fingers 30 that define the straight slots 34 to flex laterally so that the latch recesses 35 may move apart and together as the packer latch lugs move along the straight-slots between latching and release positions, discussed hereinafter. The number of the straight-slots 34 and consequently the number of the collet fingers 30, as well as the width of the collet fingers, all depend upon the loads involved in operating the latching seal unit and the packers for which each seal unit is designed. In the particular collet cage 23 illustrated at least three of the straight-slots are employed with the collet including at least six of the collet fingers 30. The collet fingers 30 are spaced apart a distance which provides spacing between the edges defining the straight-slots 34 as shorter than the diameter of the lug or lugs in the packer so that there is an interference fit between each lug and the slot edges during the operation of the latching collet cage, as discussed hereinafter. A top sub 50 is threaded on the reduced upper end portion 21 of the locator body 10. The lower end edge of the top sub engages the upper end edge of the collet cage ring 24 holding the collet cage ring on the locator body against the stop shoulder 22. The top sub has internal threads 51 for connection of the latching seal unit S to the lower end of a production tubing string, not shown, extending from the surface of a well to the seal unit. The threaded connection between the collet cage ring 24 and the locator body 10 and the top sub 50** hold the collet cage against rotation on the locator body so that if the production tubing string is turned the collet cage will turn with the seal unit.

Figure 2:
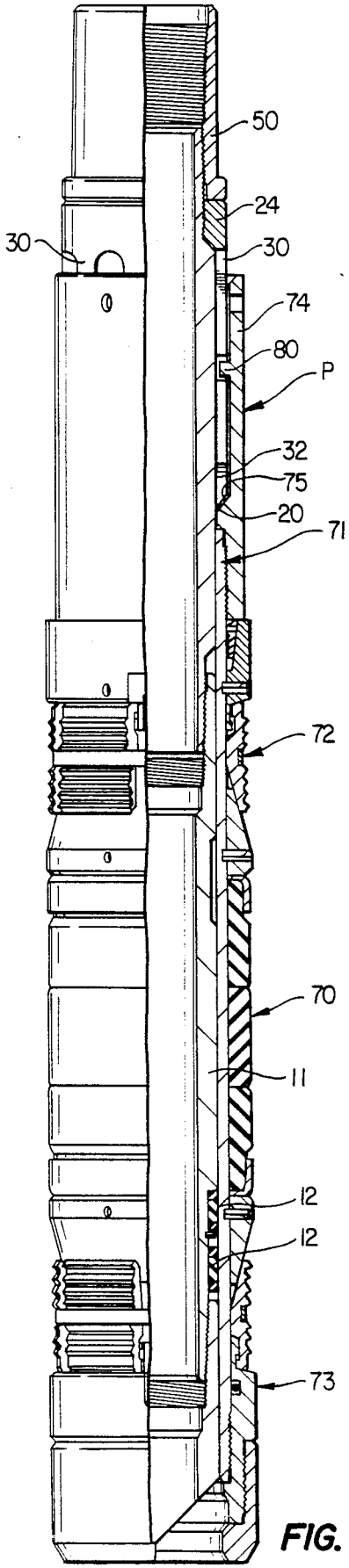
Figure 3:
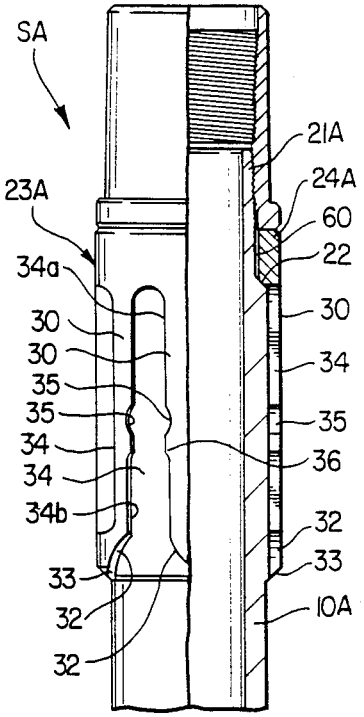

An alternate form of the latching seal unit SA is shown in FIG. 3. The seal unit SA differs from the seal unit S only in that the latching collet cage 23A is rotatable on the locator body of the seal unit. Referring to FIG. 3, the seal unit SA has a locator body 10A having a stop shoulder 22 at the lower end of a smooth external tubular bearing surface 60 between the stop shoulder 22 and the externally threaded upper end portion 21A to which the top sub 50 connects. The collet cage 23A has a top ring portion 24A having a smooth internal bore which fits over the smooth tubular portion 60 on the locator body 10A above the stop shoulder 22. The tolerances between the bore of the ring 24A and the surface 60 as well as the spacing between the lower end of the top sub 50 and the stop shoulder 22 are designed to permit the ring 24A to rotate on the locator body so that the collet cage 23A may freely turn on the locator body. The threads in the top sub 50 for connection on the locator body and the external threading along the upper end portion of the locator body are designed to limit the extent which the top sub can be tightened on the locator body to prevent binding the collet cage ring 24A. The latching seal units S and SA embodying the features of the invention may be used with a standard well packer P illustrated in FIG. 2. The packer P is a commercially available Type WB manufactured and sold by Otis Engineering Corporation, and illustrated and described at page 14 of the 1982 edition of the Otis Engineering Corporation catalog No. OEC5120D, entitled Packer Production Equipment and Services. Referring to FIG. 2, the packer P includes a seal elements package 70 mounted on a tubular packer body 71 between upper and lower slip assemblies 72 and 73. A receiving head 74 is mounted on the body 71. The receiving head 74 is connected on the packer body by a threaded connection between the lower end portion of the receiving head and the upper end portion of the packer body 71. The receiving head has an internal annular stop shoulder 75. Latching lugs 80 are secured in the receiving head extending internally into the bore of the receiving head and spaced circumferentially around the receiving head for engagement by the vertical slots of the latching collet cages 23 and 23A on the seal units S and SA. The number and spacing of the latching lugs 80 in the receiving head conforms to the number and spacing of the vertical slots 34 in the latching collet cages of the latching units S and SA. The maximum width of the latching lugs 80, the diameter where the lugs are round, exceeds the spacing between the collet finger edges defining the slots 34, the width of the vertical slots, sufficiently to provide an interference fit between the latching lugs 80 and the vertical slots 34 in the collet cages. The latching lugs, of course, are wide enough to provide the desired interference fit and small enough to fit between the latch recess surfaces 35 along the straight-slots 34 of the latching collet cages The spacing between the packer latching lugs 80 and the receiving head stop shoulder 75 is equal to the spacing between the seal unit stop shoulder 20 and the latch recesses 35 in the collet cage so that when the seal unit is properly seated in the packer, the latch lugs 80 are within the latch recesses 35 between the collet fingers along the straight-slots.

The latching seal units S and SA are normally used with packers such as the packer P which have previously been set in a well bore. For a clear understanding of the installation and the operation of the seal units, it should be recognized that the packer P as illustrated in FIG. 2, is not set in a well bore but rather is shown in the condition in which packer is run from the surface and thereafter set in a well. The illustration of the latching seal unit S installed in the packer in FIG. 2 is merely to show the relative positions or relationships of the seal unit in the bore of the packer. Such relationships are not affected by whether the packer is set or not. The packer P may be run into a well and set by use of standard wireline equipment and techniques. The setting of the packer comprises the expansion of the seal element package 70 around the packer body to engage the wall of a well casing to seal the annulus in a well around the packer between the packer body and the well casing wall. In setting the packer, the upper and lower slip assemblies 72 and 73 also are expanded to engage the casing wall for locking the packer in place. After the packer has been properly set in a well, the production tubing, not shown, for flowing well fluids from the well is then run into the well from the surface using standard equipment and procedures. The latching seal unit S, or SA, is attached the bottom tubing joint forming the production tubing string. The seal unit is connected to the production tubing string by means of the top sub 50. The production tubing string is lowered in the well until the mule-shoe guide surface 14 on the lower end of the seal unit engages the upper end of the packer P at the receiving head 74 of the packer. If the mule-shoe 13 does not immediately enter the packer bore, due possibly to lodging on the upper end edge of the packer head, the production tubing string with the latch unit is rotated to allow the mule-shoe guide surface to engage the upper end of the packer guiding the seal unit into the packer bore. Normally it would not be necessary to rotate more than 90 to 180 degrees. The mule-shoe 13 and the seal body 11 with the seal elements 12 move downwardly in the packer bore with the elements 12 engaging and sliding downwardly along the polished surface of the packer bore. When the lower end edges of the collet fingers 30 of the latching collet cage 23 at the points 33 and the guide surfaces 32 engage the lugs 80 in the receiving head 74 of the packer, the guide surfaces direct the collet cage to the proper position of rotation, if the cage is not already properly positioned, for the seal unit with the collet cage to move downwardly and the lugs 80 enter the vertical slots 34 of the collet cage. Of course, as the collet cage enters the packer head and the co-action between the lugs 80 and the guide surfaces 32 tends to align the collet cage properly with the guide lugs, if the latch unit S is being installed, the threaded connection between the collet cage and the latch unit locator body will cause the entire latch unit with the lower end of the production string to turn sufficiently to align the collet cage properly with the lugs 80. In the event that the latch unit SA is being installed, the collet cage 23A only will rotate on the locator body properly aligning with the lugs 80 as the seal unit moves downwardly relative to the lugs 80. As the cage moves on the lugs pass from the entry portions of the slots defined by the guide surfaces 32 into the straight-portions **34*b* of the slots to the latch bosses 36 which form an interference fit with the lugs. The collet fingers then spread enough for the lugs to snap past the bosses 36. When the seal unit moves the cage downwardly sufficiently for the lugs 80 to be positioned between the latch surfaces 35, the collet fingers 30 snap back together to relaxed positions in the latch surfaces 35 with the lugs between the surfaces 35. As this occurs, the snapping affect may be felt at the surface giving an indication that the seal unit is properly seated. At the same time that the snapping affect occurs, the stop shoulder surface 20 on the locator head of the seal unit engages and rests on the stop shoulder 75 in the receiving head of the packer. The operator installing the production tubing string and seal unit may pick-up on the string, and if the lugs are properly in the vertical slots between the latch surfaces 35, there will be sufficient resistance by the bosses 36 to the upward movement of the latching collet cage as the lugs 80 try to move downwardly below the latch bosses 36 that the operator will know that the seal unit is properly installed. This is, of course, in contrast with the installation of a prior art straight-slot type of seal unit which has no mechanism for providing an indication that the seal unit is properly landed. The amount of force which can be applied to give an indication that the unit is properly installed will, of course, be less than the force required to release the unit from the well packer for pulling it back to the surface. A variety of design considerations are involved in establishing the force required to install the seal unit, the force which may be applied to determine if the unit is properly installed without releasing it, and the force to release the unit. The strength and flexibility of the collet fingers 30, the slopes of the guide surfaces 32, and the slopes of the latch surfaces 35** may all be varied for setting the various forces required for installation and release of the unit, as well as how much force can be applied to check on its installation without releasing it. For example, the latching collet cage may be designed to require a 50,000 pound force on the tubing string to release the unit and a 30,000 pound pull can be applied to the string to determine if the unit is properly installed. That lower force pull would provide a positive indication at the surface of installation but would not cause release of unit from the packer. It will be understood that the landing indicator and release forces at the surface are in excess of the total weight of the tubing string and seal unit.

The primary initial operating advantage of the latching seal unit S or the latching seal unit SA is the capability of determining that the unit has been properly installed in the packer P. The determination that the seal unit has been properly installed is readily made, as previously stated, by application of an upward force of a value less than the release force. If a force is applied to lift the production tubing string in excess of the known weight of the string and less than the release force and the latching seal unit is not properly latched in the packer, the production tubing string with the seal unit is readily raised back upwardly.

If the latching seal unit S is employed it, will be recognized that after the seal unit is properly installed, the tubing string may be rotated transmitting torque to the collet cage which is in turn applied to the packer receiving head for whatever purposes rotational force may be desired. If, on the other hand, rotation of the collet cage is not desired, the seal unit SA may be used. The collet cage 23A on the seal unit SA freely rotates on the seal unit locator body so that any turning of the production tubing string is not transmitted to the collet cage 23A. Release of both types of the seal units of the invention is effected by only an upward longitudinal force. This is contrast with the release of prior art J-slot seal unit which must be turned to disengage the J-slot on the seal unit from the lug means in the receiving head of the packer.

After the installation of either of the seal units S or SA in the packer P, the production tubing string including the seal unit is free to move upwardly and back downwardly due to expansion or contraction of the tubing string without damaging the tubing string, packer, or the seal unit. As previously discussed, when a J-slot seal unit is used an essentially rigid connection is obtained between the seal unit and the packer P so that expansion or contraction of the production tubing string could damage the either the J-slot configuration of the seal unit, the lug or lugs 80 in the packer, or other well equipment associated with the seal unit or packer. It will be recognized then that the seal units of the present invention have the advantages of both the collet type seal unit and the straight-slot type seal unit. Thus, the present invention provides a surface indication of the proper installation of the seal unit as obtained in the prior art J-slot type seal unit and also permits expansion and contraction of the production tubing string available with the prior art straight-slot type sealed unit. Further, the seal units of the present invention can be designed to transfer torque or to rotate freely, as desired. Additionally, both the seal unit S and the seal unit SA, are readily usable with a standard prior art packer P which also is usable with the prior art J-slot and the prior straight-slot types of seal units. A packer which had been previously installed for use with either of these prior art type seal units is also now usable with the seal units of the present invention.

It will be recognized that a new form of seal unit is disclosed which functions in the same manner as a collet type latching seal unit while being operable with a standard packer head having an internal latching lug. Thus, the new seal unit is useful with existing equipment installed in wells and does not require a new non-standard type of well packer head.

The seal units of the present invention, further, have advantages in well completions where significant production tubing movement may be anticipated due to a possible changing well conditions. Under such circumstances, a seal bore extension, not shown, in the form of an additional length of tubing can be connected between the seal body 11 and the locator body 10 which will position the seal elements 12 significantly below the level illustrated FIG. 2. A tubing extension also may be connected to the lower end of the packer P. Such completion arrangements would permit the production tubing to be run into the well until the co-action between the collet cage and packer lugs indicates that the seal unit is in the packer and the production tubing may be then spaced-out or lifted to a desired position which will permit tubing expansion and contraction without raising or lowering the seal elements 12 above or below the polished surface within the packer or tubular extension on the packer. In this situation, of course, the collet cage and head of the head end of the seal unit would be operating above the packer lugs to permit the desired longitudinal expansion and contraction of the production tubing string.

What is claimed is:

1. A latching seal unit for providing a fluid coupling between a well tubing string and a well device having a flow passage therethrough and internal latching lug means projecting into said flow passage, said seal unit comprising:

body means having a flow passage therethrough;

seal means on said body means for sealing around said body means with a wall surface of said wall device defining said flow passage through said well device;

collet means having lug receiving means on said body means for releasably latching with said lug means in said well device to permit detection of the installation of said seal unit in said well device responsive to a first force on the well tubing from a location remote from said seal unit and to permit release of said seal unit from said well device responsive to only a longitudinal second force greater than said first force applied to said seal unit in a direction away from said well device;

said collet lug receiving means comprising slot means forming an interference fit along portions of said slot means with said lug means in said well device and having latch surfaces providing a non-interference fit with said lug means; and means on said body means for connecting said seal unit to a well tubing string.

2. A latching seal unit in accordance with claim 1 wherein said slot means comprises at least one straight-slot opening at a leading end of said collet means and having latch recess surfaces defining a latching portion of said straight-slot providing a non-interference fit with said lug means.

3. A latching seal unit in accordance with claim 2 wherein said collet means has entrance guide surfaces leading into said straight-slot for guiding said collet means onto said lug means, said lug means entering said straight-slot for movement of said collet means along said lug means until said lug means enters said latching portion of said straight-slot.

4. A latching seal unit in accordance with claim 1 including a stop shoulder on said body means for limiting the movement of said seal unit into said well device to a latching seated position in said well device.

5. A latching seal unit in accordance with claim 4 wherein said collet means is secured against rotation on said body means of said seal unit.

6. A latching seal unit in accordance with claim 4 wherein said collet means is rotatable on said body means of said seal unit.

7. A latching seal unit for providing a fluid coupling between a well tubing string and a well packer having a flow passage therethrough and an internal latching lug in a receiving head of said well packer projecting into said flow passage through said well packer, said seal unit comprising:

a tubular seal body having a flow passage therethrough;

annular seal assembly means on said seal body for sealing around said seal body with a wall surface in said packer defining said flow passage through said packer;

a guide shoe on a lower end of said seal body to guide said seal unit into said well packer flow passage;

a tubular locator body secured with said seal body and having a flow passage communicating with said flow passage of said seal body;

a latching collet cage on said locator body adapted to releasably latch with said lug means in said well packer to permit detection of the installation of said seal unit in said well packer responsive to a first force in said tubing from a location remote from said seal unit and to permit release of said seal unit responsive to only a longitudinal second force greater than said first force on said seal unit away from said well packer;

said collet cage including slot means forming an interference fit along portions of said slot means with said lug means in said packer and having latch surfaces providing a non-interference fit with lug means in said packer; and means on said locator body for connecting said seal unit to said well tubing string.

8. A latching seal unit in accordance with claim 7 wherein said slot means in said collet cage is at least one straight-slot opening at a lower end of said collet cage and having latching recess surfaces spaced from said lower end of said collet means defining a latching portion of said slot means providing a non-interfering fit with said lug means of said packer.

9. A latching seal unit in accordance with claim 8 wherein said collet cage has entrance guide surfaces leading into said straight-slot for guiding said collet means onto said lug means of said packer, said lug means entering said straight-slot as said seal unit moves into said packer.

10. A latching seal unit in accordance with claim 7 including a stop shoulder on said locator body to limit movement of said seal unit into said well packer at a latching position in said well packer.

11. A latching seal unit in accordance with claim 10 wherein said collet means is locked against rotation on said locator body.

12. A latching seal unit in accordance with claim 10 wherein said collet means is rotatable on said locator body of said seal unit.

13. A latching seal unit in accordance with claim 1 wherein said collet means comprises a collet cage having a plurality of circumferentially spaced collet fingers defining straight, downwardly opening latch lug receiving slots having downwardly divergent guide surfaces opening into said receiving slots, and lug receiving latch surfaces along said straight-slots; said collet cage forming an interference fit with said latch lug means above and below said latch surfaces and a non-interference fit with said latch lug means at said latch surfaces.

14. A latching seal unit in accordance with claim 13 wherein said collet cage is secured against rotation on said body means of said seal unit.

15. A latching seal unit in accordance with claim 13 wherein said collect cage is rotatable on said body means of said seal unit.

16. A latching seal unit for a well tubing string to effect a seal in the bore of a well packer having a receiving head provided with a plurality of latch lugs projecting into the bore of said packer, said latching seal unit comprising:

a tubular seal body having a flow passage therethrough;

tubular guide means on the lower end of said seal body for guiding said seal unit into said well packer bore;

an annular seal element on said seal body for sealing between said seal body with a wall surface defining said bore through said packer;

a locator body secured with said seal body and having a central bore defining a flow passage through said locator body communicating with said flow passage through said seal body, said locator body having an external annular downwardly facing stop shoulder for engaging a stop shoulder in said receiving head of said well packer;

a tubular latching collet cage mounted on said locator body having a ring shaped head end and circumferentially spaced collet fingers formed integral with said head end and extending toward said stop shoulder on said locator body, selected pairs of said collet fingers being circumferentially spaced to define straight lug receiving slots between said collet fingers, said collet fingers defining said straight-slots having downwardly divergent guide surface edges defining lower end entrances into said straight-slots for guiding said collet cage onto said lugs in said packer, said collet fingers having latch recess edge surfaces along opposite sides of said straight-slot spaced from said guide surfaces, said straight-slots on opposite sides of said latch surfaces being sized to form an interference fit with said packer lugs, said straight slots having portions joining said entrances forming a non-interference fit with said packer lugs and said latch surfaces being sized to form a non-interference fit with said packer lugs, said straight slots including said latch surfaces sized to permit detection of the installation of said well device responsive to a first force on said device in a direction to remove said device and permit release of said device responsive to a second force greater than said first force; and top sub means on said locator body above said collet cage for connecting said seal unit with a well tubing string.

17. A latching seal unit in accordance with claim 16 wherein said collet cage is secured against rotation on said locator body.

18. A latching seal unit in accordance with claim 16 wherein said collet cage is rotatable on said locator body.

19. A latching seal unit according to claim 16 wherein said collet fingers have lower end edges terminating above said stop shoulder on said locator body.

20. A latching seal unit according to claim 19 where each said collet finger defining one side of one of said straight-slots is joined at a lower end with an adjacent collet finger laterally spaced therefrom and a closed longitudinal slot is formed between joined collet fingers.

21. A latching seal unit in accordance with claim 2 including lateral latch bosses along opposite side edges of said straight-slot spaced apart defining an interference fit between said latch bosses, said latch bosses being positioned between an entrance end of said straight-slot and said latching portion of said straight-slot.

22. A latching seal unit in accordance with claim 9 including latch bosses along said straight-slot positioned between said entrance guide surfaces and said latching portion, said latch bosses being spaced apart to form an interference fit with said lug means.

23. A latching seal unit in accordance with claim 16 wherein latch bosses are provided along collet cage edges defining said straight-slots between said latch surfaces and said lower end entrances into said straight-slots, said latch bosses being laterally spaced to form an interference fit with said packer lugs so that said collet cage snaps past said latch bosses when said latch bosses engage said packer lugs to provide a surface indication of the engagement of said collet cage with said packer lugs.

* * * * *